United States Patent [19]

Hunsinger et al.

[11] Patent Number: 5,044,025

[45] Date of Patent: Sep. 3, 1991

[54] SAFETY DEVICE FOR BEDS WITH SIDE RAILS

[76] Inventors: Charles J. Hunsinger, 6845 Laureen, Fresno, Calif. 93710; Ralph G. Victor, 5518 Columbia Dr. S., Fresno, Calif. 93727

[21] Appl. No.: 654,293

[22] Filed: Feb. 8, 1991

[51] Int. Cl.[5] ..... A47C 21/08

[52] U.S. Cl. ..... 5/424; 5/425; 5/508

[58] Field of Search ..... 5/280, 424–427, 5/431, 508, 512

[56] References Cited

U.S. PATENT DOCUMENTS

| | | | |
|---|---|---|---|
| 993,119 | 5/1911 | Stannard | 5/512 |
| 3,619,824 | 11/1971 | Doyle | 5/424 X |
| 3,742,530 | 7/1973 | Clark | 5/425 X |
| 4,214,326 | 6/1980 | Spann | 5/424 X |
| 4,215,446 | 8/1980 | Mahoney | 5/425 |
| 4,232,415 | 11/1980 | Webber | 5/427 |
| 4,370,765 | 2/1983 | Webber | 5/427 |
| 4,672,698 | 6/1987 | Sands | 5/424 |
| 4,827,545 | 5/1989 | Arp | 5/424 |
| 4,873,734 | 10/1989 | Pollard | 5/425 |

*Primary Examiner*—Michael F. Trettel
*Attorney, Agent, or Firm*—Dennis B. Haase

[57] ABSTRACT

The invention comprises a form fitting slipcover secured about a side rail of the type commonly found on hospital beds, and having the portion of the slipcover facing the person in the bed padded to protect that person from injurious contact with the side rail, and provides a bolster which is removably attached to the slipcover by means of an elongated sheet of material, preferably of the same material as the rest of the device, such that when the bolster is at rest on the bed, between its occupant and the edge of the bed, it tends to inhibit tossing and turning of the occupant toward the bed rail, and more importantly prevents the patient from inadvertently placing or causing their limbs to be wedged between the mattress frame and the metal support for the side rail, and includes a length of material interconnecting the bolster and slipcover which, in the usual case, is about ten (10) inches in length, and allows the side rail to be placed in the down position without hindrance, due to the face that the bolster will ride up and over the top of the side rail slipcover.

13 Claims, 2 Drawing Sheets

SAFETY DEVICE FOR BEDS WITH SIDE RAILS

BACKGROUND OF THE INVENTION

The present invention relates primarily to safety apparatus, and more specifically, to devices for the protection of people reposing in a bed with side rails, whether in a primary care facility, convalescent home, or in the less structured environment of one's home.

It is universally recognized that under certain circumstances it is advisable, and possibly necessary, that a person, by virtue of their physical condition, age, infirmity, or for a variety of other conditions, sleep, or repose in a bed with side rails for the obvious purpose of preventing such a person from departing the bed inadvertently. Such persons may also be suffering from a lack of muscular control, convulsions, or agitated condition, and even under a medicated condition, toss and turn, roll over, or otherwise move into contact with the bed's side rails. Such contact, depending on the condition of the person, could result in contusions and abrasions of the skin, and, in some instances, even more serious injury is possible.

OVERVIEW OF THE PRIOR ART

Previous efforts in this environment display a rather profound lack of ingenuity in addressing this problem. Indeed, major health care facilities which face such problems more frequently than any other, have chosen to ameliorate the problem by use of sheets or pillows to safeguard the bedridden person from injurious contact.

Such rudimentary remedies, however, are fraught with problems, which make them somewhere between inconvenient and unworkable. More particularly, extension and retraction of the bed rail becomes a chore because of the interference such devices pose to such movement.

SUMMARY OF THE INVENTION

It is an objective of the present invention, therefore, to provide a safety device for use with beds having side rails which protect the person in bed from injury, while being operable with the side rails to permit free and unrestricted extension and retraction thereof with the device in place.

It is another objective of the present invention to provide a device which not only inhibits movement toward a side rail, but protects the person in bed from injury should such contact with the rail occur.

Yet another objective of the present invention is to provide a universal safety device, constructed of a pliable, easily cleanable, flame resistant, hypoallergenic material, impervious to stain or contamination by bodily fluids, bacteria and the like, which is readily installed for use, and removable for cleaning and storage, providing optimum protection against injury resulting from inadvertent contact with an extendible and retractable bed rail.

In its basic form, the invention contemplates a form fitting slipcover secured about a side rail of the type commonly found on hospital beds, and having the portion of the slipcover facing the person in the bed padded to protect that person from injurious contact with the side rail. A bolster is removably attached to the slipcover by means of an elongated sheet of material, preferably of the same material as the rest of the device, such that when the bolster is at rest on the bed, between its occupant and the edge of the bed, it tends to inhibit tossing and turning of the occupant toward the bed rail, and more importantly prevents the patient from inadvertently placing or causing their limbs to be wedged between the mattress frame and the metal support for the side rail. The uniqueness of the elongated material, which, in the usual case, is about ten (10) inches in length, allows the side rail to be placed in the down position without hindrance, due to the fact that the bolster will ride up and over the top of the side rail slipcover.

DESCRIPTION OF THE DRAWINGS

The unique features of the present invention will be better understood upon reading the detailed description provided below, when read in conjunction with the drawings, wherein.

DESCRIPTION OF THE PREFERRED EMBODIMENT

Figure 1:
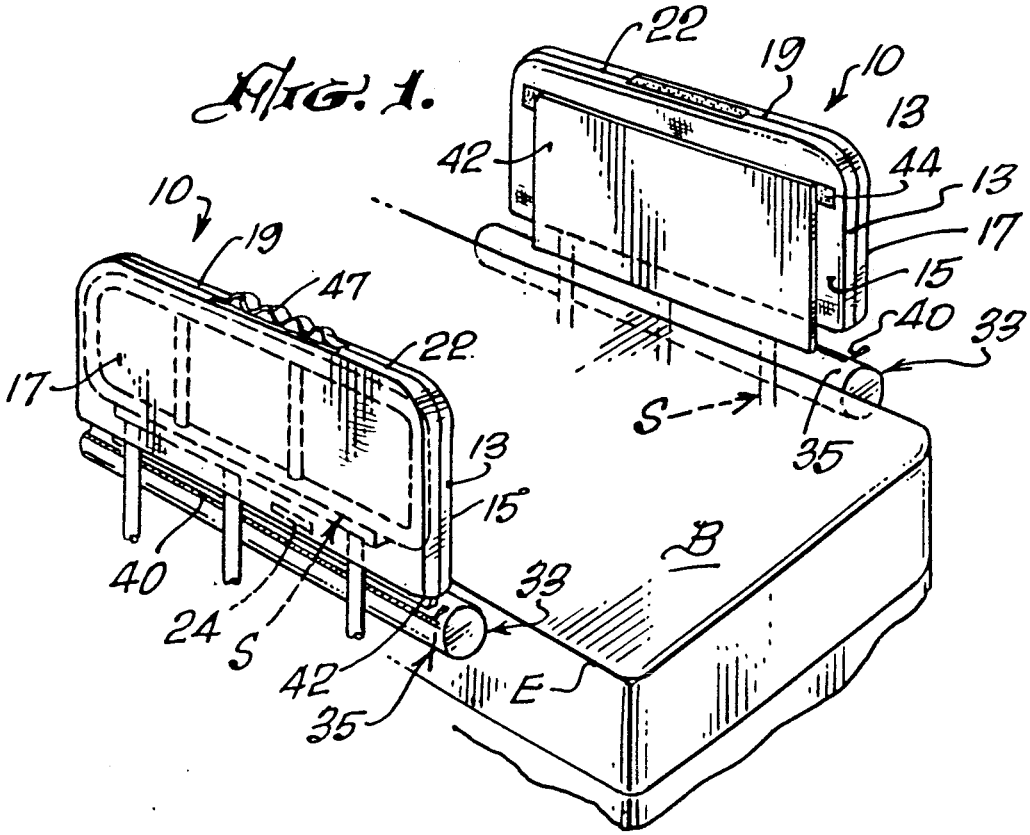
FIG. 1 is a perspective of a bed having side rails fitted with the safety device of the present invention, illustrating one environment in which the invention has great utility.

With reference now to the drawings, and initially to FIG. 1, a safety device 10 is shown in its "in use" position, fitted about a side rail S, mounted on a bed B, along a longitudinal edge E thereof. In the usual case, of course, there is a pair of side rails on each such bed, mounted in opposed relationship, so as to inhibit a person reposing in the bed from exiting the bed unintentionally from either side.

Figure 5:
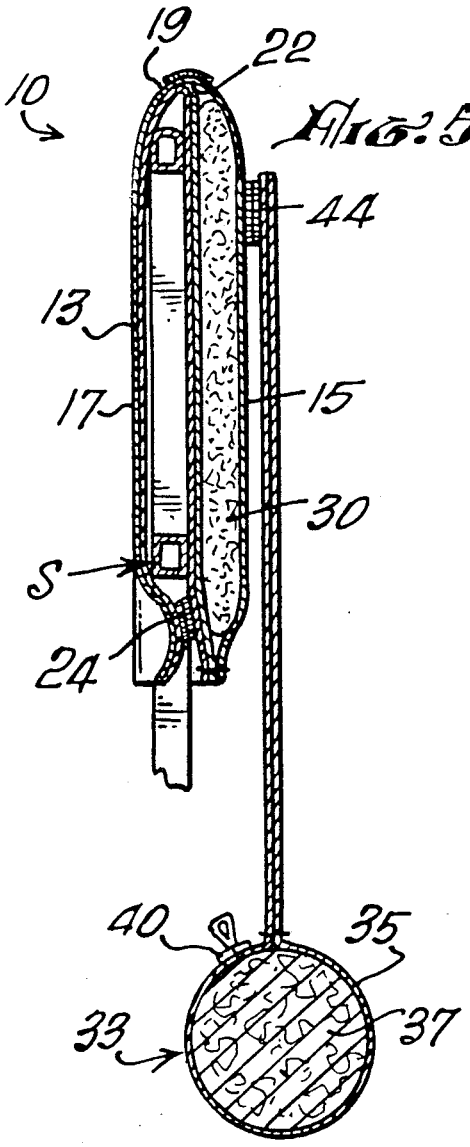
FIG. 5 is an end view, as in FIG. 4, partially sectioned to illustrate the construction of the device.

In keeping with the objective of the invention to provide a safety device which is easily installed and removable for cleaning and storage, the safety device 10 includes a form fitting slipcover 13, comprising a "U" shaped piece of flexible, clothlike material, having the character previously described, and having an inner, or facing side, or panel, 15, which is always toward the person in the bed, and the outer, opposing side, or panel, 17, which faces away from the bed, Although unitary construction is the most practical, the inner and outer side portions meet at a top portion 19, and may be discrete panels. In keeping with this aspect of the invention, the respective ends are sewn together to define a side seam at 22. It will be appreciated that the construction described results in the pocket, or slipcover, 13 that is form fitted to the bed or side rails to be easily installed or removed. Referring to FIG. 5, a fabric hook and loop device, such as a fastener sold under the trademark VELCRO, is provided at 24. Such a fastener, and several varieties are contemplated without departure from the invention, permits the slipcover to be readily secured in its mounted position.

In keeping with another aspect of the invention, the inner, or facing side, member 15 is of double wall construction, as best seen in FIG. 5, and a pliable material, such as cotton batting 30 is inserted to thereby provide a padded area facing the person in bed to protect that person against intrusive or injurious contact with the side rails.

Figure 2:
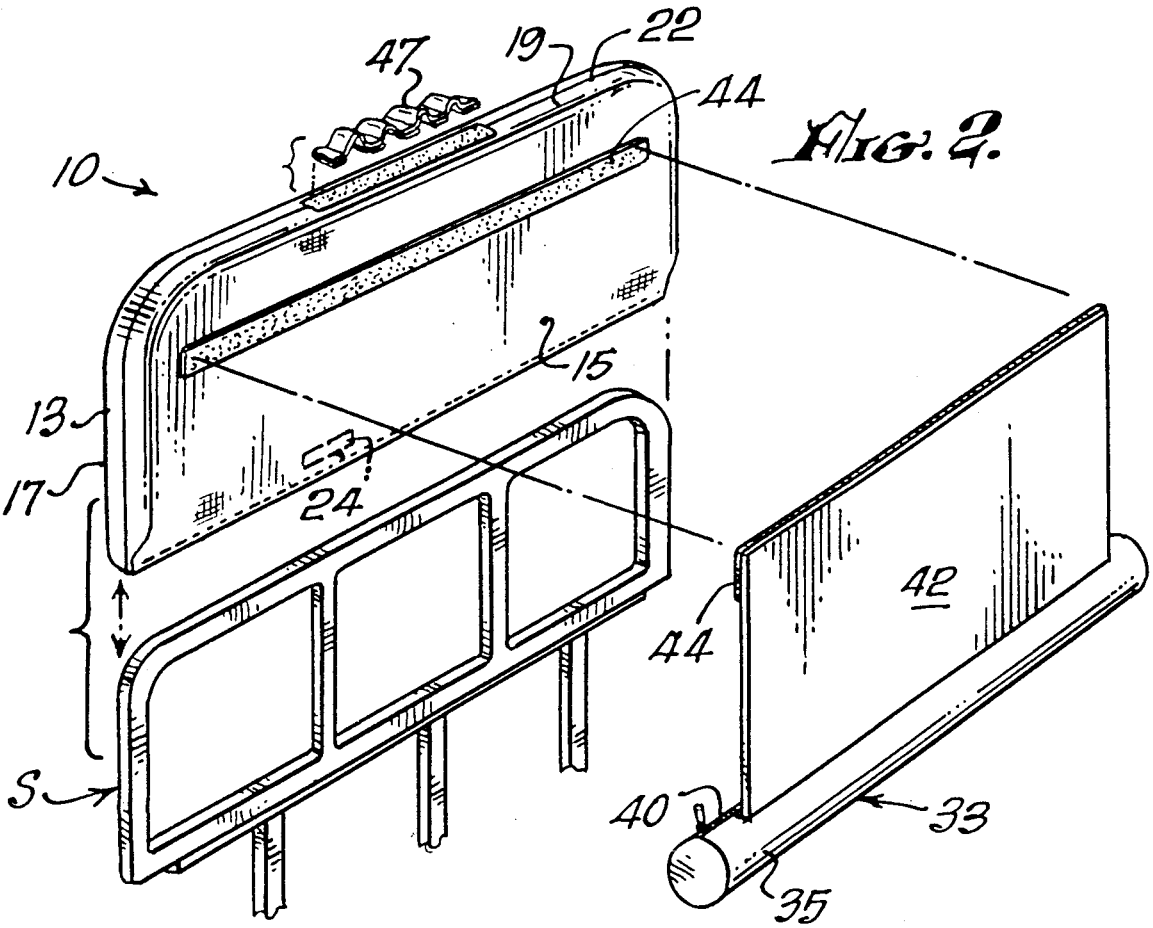
FIG. 2 is a partially exploded perspective of a safety device of the present invention, illustrating the interrelationship of its various elements.
Figure 3:
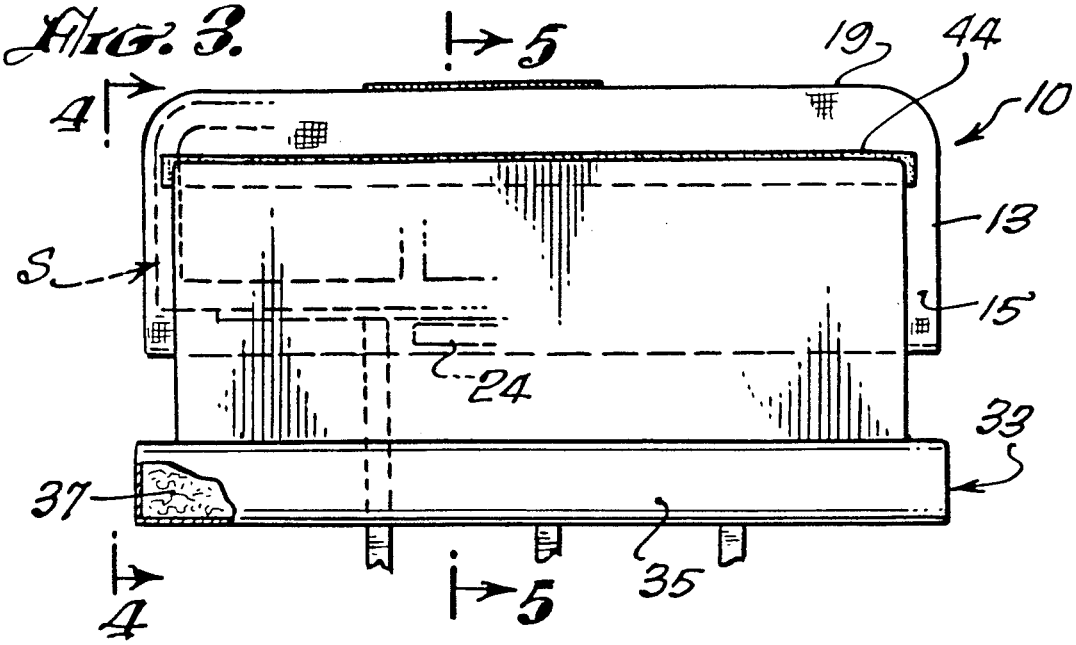
FIG. 3 is a side elevation of a safety device of the present invention.
Figure 4:
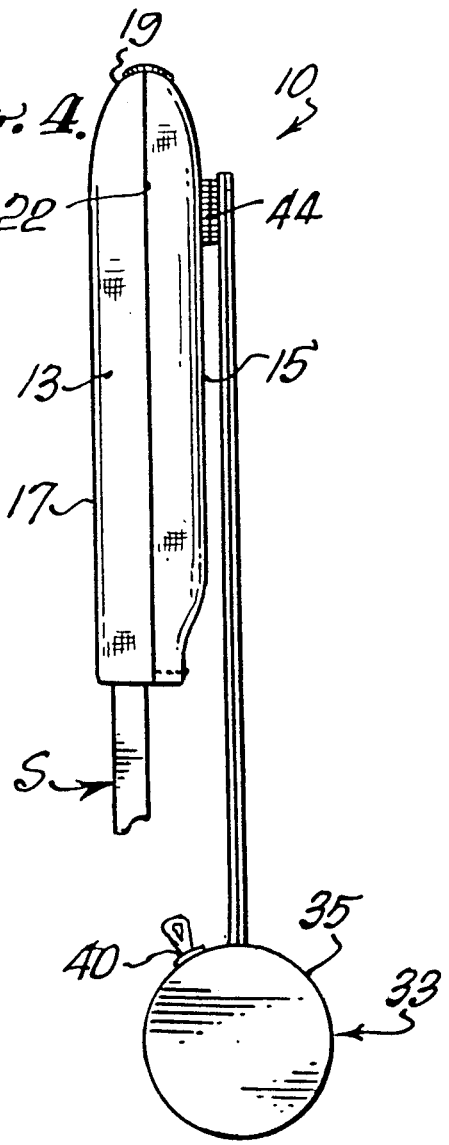
FIG. 4 is an end view of the device illustrated in FIG. 3.

Persons required to be in beds with rails, not unlike those who are not so confined, tend to be restless, moving from side to side, and tossing and turning. The present invention has, as another of its objectives, the provision of a novel safety device which tends to inhibit tossing and turning movement toward the side of the bed, which might cause a limb to be wedged between mattress and rail, as well as contact with the side rail. This is accomplished by the provision of a bolster, or pillow means, 33. As best seen in FIGS. 2, 4 and 5, and bolster 33 comprises an outer, cylindrically shaped, cover 35, which encases a pliable cushion material 37. A zipper access 40 is provided in the cover to permit removal and replacement of the cushion.

In order to permit the side rails to be raised and lowered with the safety device in place, the bolster is removably secured to the inner side 15, of the slipcover 13, by means of an elongated sheet of material 42, which is sewn, or otherwise secured to the bolster cover 33, and is removably secured by means of a hook and loop fabric connection 44 to the inner side 15, as best seen in Figure 5.

The invention, in yet another aspect, provides a series of hook and loop fabric hold down devices 47, along the top surface 19 of the slipcover to permit tubes and other medical devices, to be secured against tangling or inadvertent disconnection.

Having thus described the preferred embodiment of our invention, what is claimed is:

1. In a device for protecting a patient, in a bed having side rails, from contusions and other injuries resulting from inadvertent contact with the rails, comprising, in combination:

means defining a slip cover constructed to securably fit over and about said side rails;

bolster means depending from said slipcover means, said bolster means being disposed in a plane parallel with said rail;

said bolster means including an elongated tubular member composed of a pliable material reposing on the surface of the bed, in proximity to the patient so as to yieldably inhibit movement by the patient into said rail.

2. The device as set forth in claim 1, wherein said bolster is removably fastened to said slipcover.

3. The device as set forth in claim 2, wherein means is provided along a top portion of said slipcover for securing tubes or the like thereto.

4. The device as set forth in claim 2, wherein at least that portion of said slipcover facing the patient is padded so as to minimize injury to the patient who may come in contact therewith;

means is provided along a top portion of said slipcover for securing tubes or the like thereto.

5. The device as set forth in claim 2, wherein at least that portion of said slipcover facing the patient is padded so as to minimize injury to the patient who may come in contact therewith;

said bolster is removably fastened to said slipcover;

means is provided along a top portion of said slipcover for securing tubes or the like thereto.

6. The device as set forth in claim 2, wherein at least that portion of said slipcover facing the patient is padded so as to minimize injury to the patient who may come in contact therewith;

said bolster includes a length of material interconnecting said tubular member of said bolster and said slipcover, said material being of such length as to permit said bed rail to be raised and lowered without interference with, or removal of, said device.

7. The device as set forth in claim 1, wherein said slipcover is form fitted about said bed rails and is fabricated of a material which is nonabrasive, hypoallergenic and cleanable.

8. The device as set forth in claim 1, wherein means is provided along a top portion of said slipcover for securing tubes or the like thereto.

9. The device as set forth in claim 1, wherein said bolster includes a length of material interconnecting said tubular member of said bolster and said slipcover, said material being of such length as to permit said bed rail to be raised and lowered without interference with, or removal of, said device.

10. The device as set forth in claim 1, wherein said bolster includes a length of material interconnecting said tubular member of said bolster and said side cover, and said length of material is detachably secured to said slipcover.

11. The device as set forth in claim 1, wherein at least that portion of said slipcover facing the patient is padded so as to minimize injury to the patient who may come in contact therewith.

12. The device as set forth in claim 1, wherein said bolster is removably fastened to said slipcover;

said bolster includes a length of material interconnecting said tubular member of said bolster and said slipcover, said material being of such length as to permit said bed rail to be raised and lowered without interference with, or removal of, said device;

said length of material is detachably secured to said slipcover.

13. The device as set forth in claim 1, wherein said bolster is removably fastened to side slipcover;

said bolster includes a length of material interconnecting said tubular member of said bolster and said slipcover, said material being of such length as to permit said bed rail to be raised and lowered without interference with, or removal of, said device;

said length of material is detachably secured to said slipcover;

means is provided along a top portion of said slipcover for securing tubes or the like thereto.

* * * * *